US006620992B1

(12) United States Patent
Kinnaird

(10) Patent No.: US 6,620,992 B1
(45) Date of Patent: Sep. 16, 2003

(54) STORAGE OF REEDS FOR BAGPIPES AND THE LIKE

(76) Inventor: Robert J. Kinnaird, 918 Budz Green, Saskatoon, SK (CA)

( * ) Notice: Subject to any disclaimer, the term of this patent is extended or adjusted under 35 U.S.C. 154(b) by 0 days.

(21) Appl. No.: 10/146,428

(22) Filed: May 14, 2002

(51) Int. Cl.[7] ..... G10G 3/00
(52) U.S. Cl. ..... 84/453; 206/314
(58) Field of Search ..... 84/453; 206/314

(56) References Cited

U.S. PATENT DOCUMENTS 4,674,630 A * 6/1987 Kirck ..... 206/205
5,936,178 A * 8/1999 Saari ..... 84/453

* cited by examiner

*Primary Examiner*—Kimberly Lockett
(74) *Attorney, Agent, or Firm*—Patterson, Thuente, Skaar & Christensen, P.A.

(57) ABSTRACT

A storage apparatus for musical reeds comprises a container comprising a reed chamber adapted for holding a reed, and a humidity controlling chamber arranged such that air is exchanged substantially freely between the reed chamber and the humidity controlling chamber. A humidity controlling mixture, comprising a salt, a superabsorber, and water, is contained within the humidity controlling chamber. The amount of water is such that a portion of the salt remains undissolved, and such that water saturated with the salt is absorbed by the superabsorber. The apparatus can be adapted to attach to an instrument so that the reed can be stored in a humidity controlled environment while in its playing position on the instrument.

12 Claims, 2 Drawing Sheets

STORAGE OF REEDS FOR BAGPIPES AND THE LIKE

This invention is in the field of reeds for musical instruments, and in particular the storage of such reeds.

BACKGROUND

It is well known that humidity controlled storage is desirable for musical reeds. While synthetic reeds, made from plastic and the like, are generally impervious to moisture, reeds made from natural materials, such as cane, absorb and give off moisture. When removed from storage and placed in the instrument for playing, it can take some playing time for the reed to absorb moisture from the player's breath so as to reach an equilibrium playing humidity. The tone of the instrument changes as the moisture content of the reed changes, and becomes satisfactorily constant once equilibrium is achieved. It is desirable to store the reeds at a humidity approximating the playing humidity to reduce the playing time required to achieve equilibrium.

Flat reeds, such as those used in a clarinet or saxophone are preferably clamped to maintain their flat shape during storage. Double curved reeds, such as those used in a bagpipe, oboe, or bassoon are not clamped.

U.S. Pat. No. 4,674,630 to Kirck provides a reed storage case. The reeds are clamped against the center wall of a reed slide which is then inserted into a substantially sealed case with a hygrostat comprising a mixture of salt, silica gel and activated charcoal.

In operation the reeds are first soaked, as if in preparation for playing. The length of soaking time depends on the dryness of the reeds, but it is indicated that care must be taken not to introduce too much moisture too quickly, since humidity near 100% may cause mold and mildew. Various ways are described to reduce the moisture in the case to the desired range.

The hygrostat of the Kirck case maintains a substantially constant humidity in the case but is unable to supply moisture to a dry reed, or apparently absorb sufficient moisture from the case when a reed is introduced into the case that is too wet. Considerable trial and error appears to be required in order to properly store reeds in the Kirck case.

Some wind instruments such as bagpipes present further problems with respect to reed removal and storage. The reed in a bagpipe comprises a pair of curved blades tied with a binding to a hollow reed insert, or staple. The exposed end of the staple is inserted into a socket in the air input end of the bore of the chanter, which in turn is inserted into the bag. Air from the bag is expelled between the curved blades, through the staple, and out through the bore, either through the finger holes or the output end of the bore. A string or hemp is typically wrapped around the exposed end of the staple to control the depth of insertion of the staple into the socket. As this insertion depth varies, the tone and pitch of the chanter varies as well. Once the desired depth that results in the desired tone and pitch is achieved, it would be desirable to leave the reed in place in the chanter rather than going through the trial and error of reinsertion. This is presently not practical since it is also desirable to store the reed in a sealed container to maintain at least some humidity, especially in dry environments.

Oboes, bassoons and like woodwind instruments have similar reeds where it is also desirable to store the reed in position on the instrument.

SUMMARY OF THE INVENTION

It is an object of the present invention to provide a storage apparatus for reeds that will maintain the reed at a desired humidity.

It is a further object of the present invention to provide such a storage apparatus that has the ability to absorb and supply moisture as required to maintain the humidity of the storage chamber at a desired level as reeds having varying moisture levels are placed in the storage chamber.

It is a further object of the present invention to provide such a storage apparatus that can be attached to an instrument so that the reed can be left in place in the instrument while being stored.

The present invention provides, in one aspect, a storage apparatus for musical reeds comprising a container comprising a reed chamber adapted for holding a reed, and a humidity controlling chamber arranged such that air is exchanged substantially freely between the reed chamber and the humidity controlling chamber. A humidity controlling mixture, comprising a salt, a superabsorber, and water, is contained within the humidity controlling chamber. The amount of water is such that a portion of the salt remains undissolved, and such that the water is saturated with the salt and is absorbed by the superabsorber.

In a second aspect the present invention provides an apparatus for maintaining a reed at a substantially constant humidity while in its playing position in an air input end of a bore of an instrument. The apparatus comprises a container comprising a reed chamber and a humidity controlling chamber arranged such that air is exchanged substantially freely between the reed chamber and the humidity controlling chamber. The reed chamber has an open end adapted to be attached and sealed over the reed and air input end of the bore. The humidity controlling chamber contains a humidity controlling mixture comprising a salt, a superabsorber, and water, wherein the amount of water is such that a portion of the salt remains undissolved, and such that the water is saturated with the salt and is absorbed by the superabsorber. A seal is adapted to prevent ambient air from contacting the reed through an air output area of the bore.

The humidity controlling mixture utilizes the known property of a salt solution to maintain a constant humidity by absorbing and releasing moisture. Where the salt is potassium chloride humidity is maintained at about 85% which has been found very suitable for bagpipe reeds. Other salts may be used for different humidity levels for different reeds. Sodium chloride salt maintains humidity at about 75% for example.

The superabsorber is conveniently a polyacrylarnide such as Watersorb™, made by Polymers Inc., of Hot Springs, Ark. When water is added to the salt and superabsorber, a portion of the salt dissolves to saturate the water, and the saturated water is absorbed by the superabsorber. A portion of the salt remains undissolved, allowing the humidity controlling mixture to absorb further moisture from the container, such as when an overly wet reed is placed therein, and still maintain the water saturated with the salt to maintain the proper humidity. Where a dry reed is placed in the container, moisture is drawn out of the superabsorber and into the container to raise the moisture level of the reed.

The addition of a superabsorber allows the humidity controlling mixture to be substantially solid, avoiding spillage problems associated with a liquid, while still allowing the salt solution to maintain the proper humidity. A salt solution will supply humidity to the surrounding air until the solution is dried out. The superabsorber allows for storage of considerable salt solution in essentially a solid form, allowing the humidity controlling mixture to supply or absorb solution as required to either add or remove moisture from reeds to bring them to the desired moisture level.

The apparatus of the invention can be adapted to an instrument such as a bagpipe chanter, oboe, bassoon, or the like so that the reed can be left in place in the instrument and stored at a constant humidity. The container is attached to the air input end of the instrument so that the reed is enclosed in the reed chamber, and then the instrument is sealed so that ambient air is prevented from entering the opposite output end of the instrument and contacting the reed. Conveniently a rod with a seal or plug on the end is pushed into the opposite output end of the instrument's bore to seal the reed in the reed chamber where the humidity is controlled.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
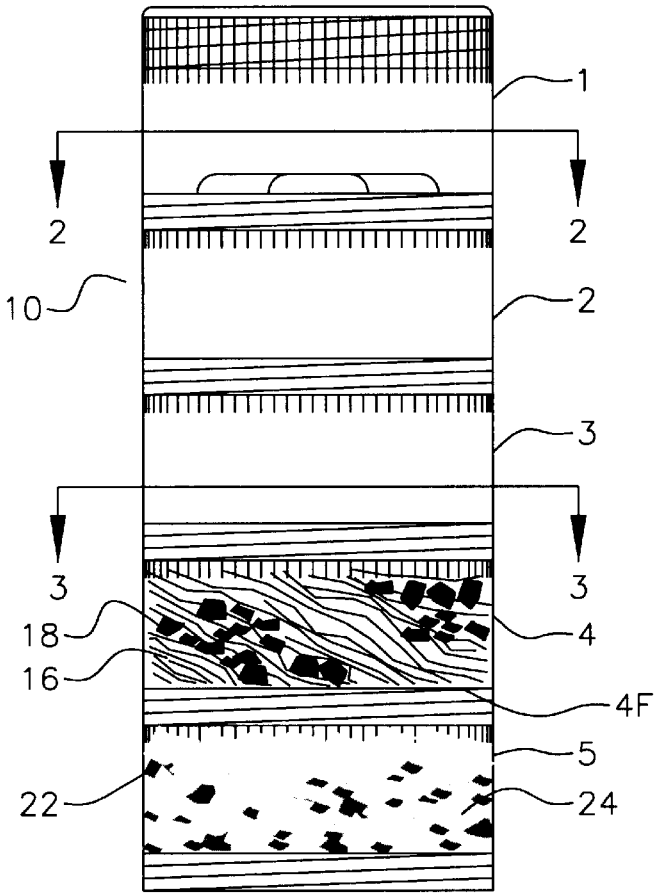
FIG. 1 is a side view of a storage apparatus of the invention
Figure 2:
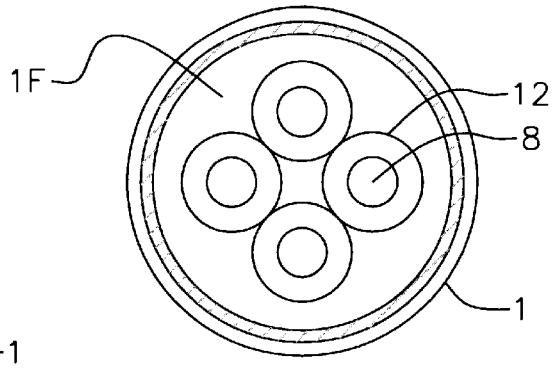
FIG. 2 is a cross-section view along 2—2 in FIG. 1.

FIG. 1 illustrates a storage apparatus for musical reeds comprising a container 10. In the illustrated embodiment, the container 10 is made up of five clear plastic cylinders 1, 2, 3, 4, 5 that screw together. The top three cylinders 1, 2, 3 form a reed chamber. The top cylinder 1 is sealed with a cap. The floor 1F of the top cylinder 1 is illustrated in FIG. 2, and defines a plurality of reed apertures 8 adapted to hold reeds 14.

Figure 4:
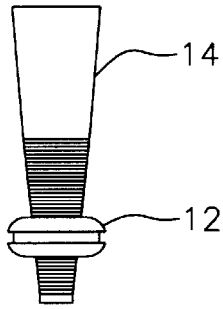
FIG. 4 is a side view of a reed held upright in a grommet.

A rubber grommet 12 is placed in each reed aperture 8, and a reed 14 can be placed into each grommet 12, as illustrated in FIG. 4. The floor of the second cylinder 2 is removed so that there is no barrier between cylinders 2 and 3, and these two cylinders provide an open space to accommodate various reeds 14. If this space is not required, cylinder 2 could simply be removed.

Figure 3:
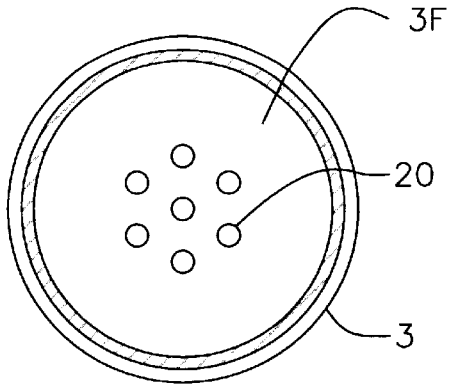
FIG. 3 is a cross-section view along 3—3 in FIG. 1.

The fourth cylinder 4 forms a filter chamber containing a filter material 16 and a quantity of activated charcoal 18. The activated charcoal 18 absorbs organic molecules and reduces organic activity and odors. The floor 3F of the third cylinder 3 is illustrated in FIG. 3 and defines a plurality of air holes 20 that allow air to be exchanged freely between the filter chamber and reed chamber.

The fifth cylinder 5 forms a humidity controlling chamber. The floor 4F of the fourth cylinder 4 is the same as the floor 3F of the third cylinder 3 and defines similar air holes 20 that allow air to be exchanged freely between the filter chamber and humidity controlling chamber. The perforated floors 3F, 4F thus allow air to be exchanged freely between the reed chamber and the humidity controlling chamber through the filter chamber. All air that passes back and forth is thus filtered by the activated charcoal 18 and filter material 16, minimizing organic activity.

Alternatively the reed, filter, and humidity controlling chambers could be oriented side by side, or in various arrangements so long as air passes freely throughout the container.

The humidity controlling chamber holds a humidity controlling mixture comprising a salt 22, a superabsorber 24, and water. The amount of water is such that a portion of the salt 22 remains undissolved. The water is saturated with the salt 22 and is absorbed by the superabsorber 24. In the illustrated embodiment the superabsorber 24 comprises a polyacrylamide polymer. When water is added to the salt 22 and superabsorber 24, a portion of the salt 22 dissolves to saturate the water, and the saturated water is absorbed by the superabsorber 24. As can be seen in FIG. 1, no liquid water remains in cylinder 5, as all has been absorbed.

Also as can be seen in FIG. 1, a portion of the salt 22 remains undissolved, allowing the humidity controlling mixture to absorb further moisture from the container 10, such as when an overly wet reed is placed therein, and still maintain the water saturated with the salt 22 to maintain the proper humidity. Where a dry reed is placed in the container 10, moisture is drawn out of the superabsorber 24 and into the container 10 to raise the moisture level of the reed 14. For bagpipe reeds, it has been found that where the salt used is potassium chloride, and humidity is maintained at about 85%, good results are achieved as the reed plays fairly well as soon as it is removed from storage.

Figure 5:
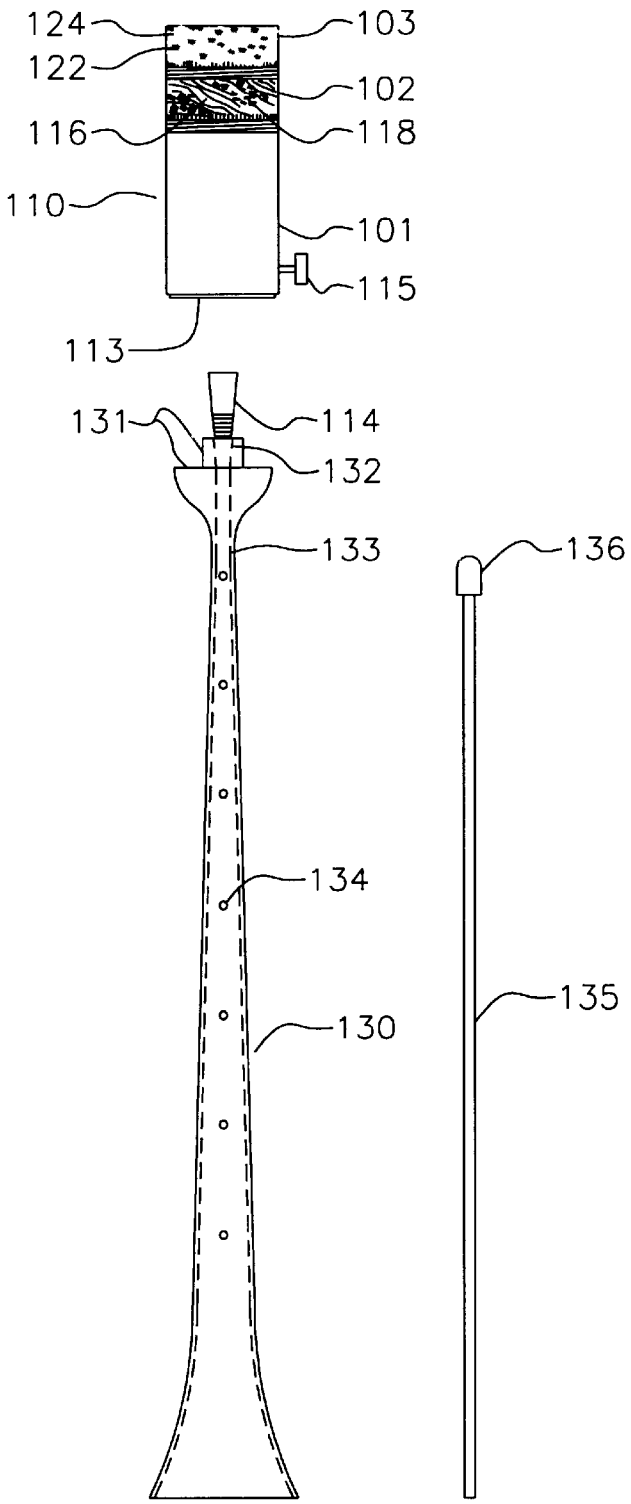
FIG. 5 is side view of an apparatus for use on a bagpipe chanter to allow the reed to be left in place on the chanter during controlled humidity storage.
Figure 6:
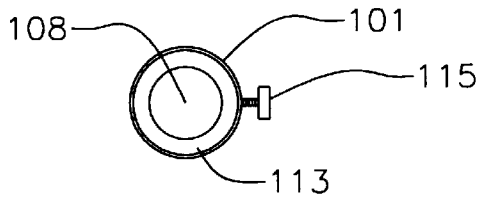
FIG. 6 is an end view of the apparatus of FIG. 5.

FIG. 5 illustrates an apparatus for maintaining a reed 114 at a substantially constant humidity while in its playing position in an air input end of the bore 133 of an instrument, illustrated as a bagpipe chanter 130. For playing, the reed 1 14 is inserted into the upper end of a reed socket 132 in the air input end of the bore 133 at the reed end 131 of the instrument. The lower end of the reed socket 132 communicates with the bore 133 so that air entering the upper end of the reed socket 132 passes through the bore to the air output area of the bore 133 comprising the finger holes 134 and the air output end of the bore 133.

The apparatus comprises a container 110 comprising three plastic cylinders 101, 102, 103 screwed together as in container 10 described above. The floors between cylinders 101, 102, 103 are perforated with air holes as in the floor illustrated in FIG. 3 so that air is exchanged freely between the cylinders.

The lower end of the cylinder 101 defines a reed aperture 108 that is surrounded by a seal 113. The apparatus 110 is placed over the reed 114 and secured to the reed end 131 of the chanter 130 by turning lock screw 115 which then bears against the wall of the reed end 131 of the chanter 130. The seal 113 seals against the reed end 131 of the chanter 130 so that ambient air is substantially prevented from entering the cylinder 101. To prevent ambient air from reaching the reed through the air output area of the bore 133 a seal, illustrated as a rod 135 having a sealing end 136 is inserted into the air output end of the bore 133 opposite the reed 114 to seal the bore 133 between the reed 114 and the air output area of the bore 133. The reed 114 is thus sealed within cylinder 101.

While the illustrated rod 135 is simple and requires only one part, alternative sealing means could be used, such as sealing the air output area of the bore 133 with plugs or the like in the finger holes 134 and in the air output end of the bore 133.

The cylinder 101 thus forms the reed chamber. Cylinder 102 forms the filter chamber containing filter material 116 and activated charcoal 118. Cylinder 103 forms the humidity controlling chamber and contains the humidity controlling mixture of salt 122, superabsorber 124, and water. Air is freely exchanged between the humidity controlling chamber, cylinder 103, and the reed chamber, cylinder 101, through the filter chamber, cylinder 102. The container 110 works in the same fashion as the container 10 described above, with the advantage that the reed 114 can be left in place in the chanter 130.

The instrument is illustrated as a bagpipe chanter, however the apparatus could be adapted for use on an oboe, bassoon, clarinet, or like instrument with appropriate modifications.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

I claim:

1. A storage apparatus for musical reeds comprising:

a container comprising a reed chamber adapted for holding a reed, and a humidity controlling chamber arranged such that air is exchanged substantially freely between the reed chamber and the humidity controlling chamber;

a humidity controlling mixture comprising a salt, a superabsorber, and water, the humidity controlling mixture contained within the humidity controlling chamber, wherein the amount of water is such that a portion of the salt remains undissolved, and such that the water is saturated with the salt and is absorbed by the superabsorber.

2. The apparatus of claim 1 wherein the superabsorber comprises a polyacrylamide polymer.

3. The apparatus of claim 1 wherein the salt is potassium chloride.

4. The apparatus of claim 1 wherein the container further comprises a filter chamber arranged such that air is exchanged substantially freely between the filter chamber and reed chamber, and between the filter chamber and the humidity controlling chamber, and wherein the filter chamber contains a filter material and activated charcoal.

5. The apparatus of claim 4 wherein the filter chamber is located between the reed chamber and the humidity controlling chamber such that air that is exchanged between the reed chamber and the humidity controlling chamber passes through the activated carbon and filter material.

6. An apparatus for maintaining a reed at a substantially constant humidity while in its playing position in an air input end of a bore of an instrument, the apparatus comprising:

a container comprising a reed chamber and a humidity controlling chamber arranged such that air is exchanged substantially freely between the reed chamber and the humidity controlling chamber;

wherein the reed chamber has an open end adapted to be attached and sealed over the reed and air input end of the bore;

a humidity controlling mixture comprising a salt, a superabsorber, and water, the humidity controlling mixture contained within the humidity controlling chamber, wherein the amount of water is such that a portion of the salt remains undissolved, and such that the water is saturated with the salt and is absorbed by the superabsorber; and a seal adapted to prevent ambient air from contacting the reed through an air output area of the bore.

7. The apparatus of claim 6 wherein the seal comprises a rod having a sealing end adapted to be inserted into an air output end of the bore opposite the air input end to seal the bore between the reed and the air output area of the bore.

8. The apparatus of claim 6 wherein the superabsorber comprises a polyacrylamide polymer.

9. The apparatus of claim 6 wherein the salt is potassium chloride.

10. The apparatus of claim 6 wherein the container further comprises a filter chamber arranged such that air is exchanged substantially freely between the filter chamber and reed chamber, and between the filter chamber and the humidity controlling chamber, and wherein the filter chamber contains a filter material and activated charcoal.

11. The apparatus of claim 10 wherein the filter chamber is located between the reed chamber and the humidity controlling chamber such that air that is exchanged between the reed chamber and the humidity controlling chamber passes through the activated carbon and filter material.

12. The apparatus of claim 11 wherein the filter chamber is attached to an end of the reed chamber opposite the open end thereof, and wherein the humidity controlling chamber is attached to the filter chamber on an end thereof opposite the reed chamber.

* * * * *